United States Patent [19]

Mack et al.

[11] Patent Number: 4,498,237

[45] Date of Patent: Feb. 12, 1985

[54] HAIR TRIMMER

[75] Inventors: William Mack, Commack, N.Y.; Herbert Morrison, Trumbull; Frank Chiapetta, Woodbury, both of Conn.

[73] Assignee: Clairol Incorporated, New York, N.Y.

[21] Appl. No.: 459,009

[22] Filed: Jan. 18, 1983

[51] Int. Cl.[3] ..... B26B 19/02; B26B 19/20

[52] U.S. Cl. ..... 30/200; 30/216; 30/220; 30/221

[58] Field of Search ..... 30/195, 200, 210, 216, 30/220, 221, 214, 215, 217, 218, 219, 201, 224

[56] References Cited

U.S. PATENT DOCUMENTS

| | | | |
|---|---|---|---|
| 2,331,319 | 10/1943 | Hardy | 30/214 X |
| 2,717,443 | 9/1955 | Turbett | 30/222 X |
| 3,083,456 | 4/1963 | Marchant | 30/210 |
| 3,646,675 | 3/1972 | Wezel | 30/224 X |
| 4,214,365 | 7/1980 | Walter | 30/224 X |
| 4,221,050 | 9/1980 | Walter | 30/216 |
| 4,348,810 | 9/1982 | Oda | 30/200 |

FOREIGN PATENT DOCUMENTS

| | | | |
|---|---|---|---|
| 203615 | 9/1923 | United Kingdom | 30/215 |

*Primary Examiner*—Jimmy C. Peters

*Attorney, Agent, or Firm*—Stuart E. Krieger; Gene Warzecha

[57] ABSTRACT

The present invention is a cutting unit having multiple sets of tandem blades; each set being composed of a first toothed blade moved reciprocatingly in a cutting motion relative to a second tooth blade. The blades are preferably curved.

11 Claims, 6 Drawing Figures

HAIR TRIMMER

BACKGROUND OF THE INVENTION

1. Field of the Invention.

The present invention relates generally to cutting units and more particularly to a hair trimmer.

2. Description of the Prior Art.

There are numerous cutting units known in the art. One type of unit utilizes a reciprocating tooth blade moving relative to a second blade. The blades are aligned substantially longitudinally of the device and its handle. When this arrangement is utilized in a hair trimmer, the device can be conveniently used by an untrained individual because the orientation of the blades is similar to that of a comb. Using blades with a curved cutting edge further facilitates trimming and proper shaping of the hair.

Disadvantageously, as is known in the art, see e.g. U.S. Pat. No. 4,214,365 to Walter, et al., when these reciprocating cutting units have a high motor and blade speed the noise is a deterrent to its use. When low motor and blade speeds are utilized, the motor noise factor may be reduced, but the sickle bar or mowing-machine noise of the blade remains, particularly if the blade is long.

These units also have relatively high costs and complex constructions which make assembly, repair and cleaning difficult. A major factor in the cost is the fabrication of a long moveable cutting blade. The dimensions of a long, moveable blade require exactitude in fabrication since improper frictional contact with the second blade is capable of producing a substantial noise when reciprocated and increased wear and tear on cutting components. A curvature in a long cutting blade further increases its cost. Prior art reciprocating cutting units have not been entirely satisfactory, with respect to noise, maintainability and cost.

It is, accordingly, an object of the present invention to provide an easily manipulated, efficient, quiet, hair trimmer having relatively few components that is particularly well-adapted for self-use.

It is an additional object of the present invention to provide a hair trimmer which can be drawn through a bed of hair in a combing motion while shearing off hair segments.

It is a further object of the present invention to provide a hair trimmer having a cutting unit with multiple aligned curvate cutting blades which are coupled for simultaneous reciprocation.

It is also an object of the present invention to provide a hair trimmer having multiple cutting blades which are aligned to form a curvature in their cutting edges approximating the curvature of the human head.

SUMMARY OF THE INVENTION

These objects and features are accomplished by the present invention wherein a cutting unit comprises the following: a cutting assembly including multiple sets of tandem blades, each set having a separate first toothed blade bearing against, and slideable along, an adjacent second toothed blade in a reciprocating cutting motion, the first blade of the multiple sets being longitudinally aligned and coupled for simultaneous reciprocating motion relative to the second blade of each set, and reciprocating means for producing said reciprocating motion in said first set of blades. There is preferably a support plate adjacent the second blade in each set which is fixedly secured in a stationary position by attachment, direct or indirect, to the housing.

In cutting units used for hair trimming, a hand holdable casing is provided having a longitudinal slot permitting the teeth of the tandem blades to extend out of the casing. The tandem blades are curved, aligned and complimentary so as to form a curvature approximating that of the human head.

BRIEF DESCRIPTION OF THE DRAWINGS

These and other objects and features of the invention will become apparent with references to the following specification and drawings wherein.

DESCRIPTION OF THE PREFERRED EMBODIMENT

Figure 1:
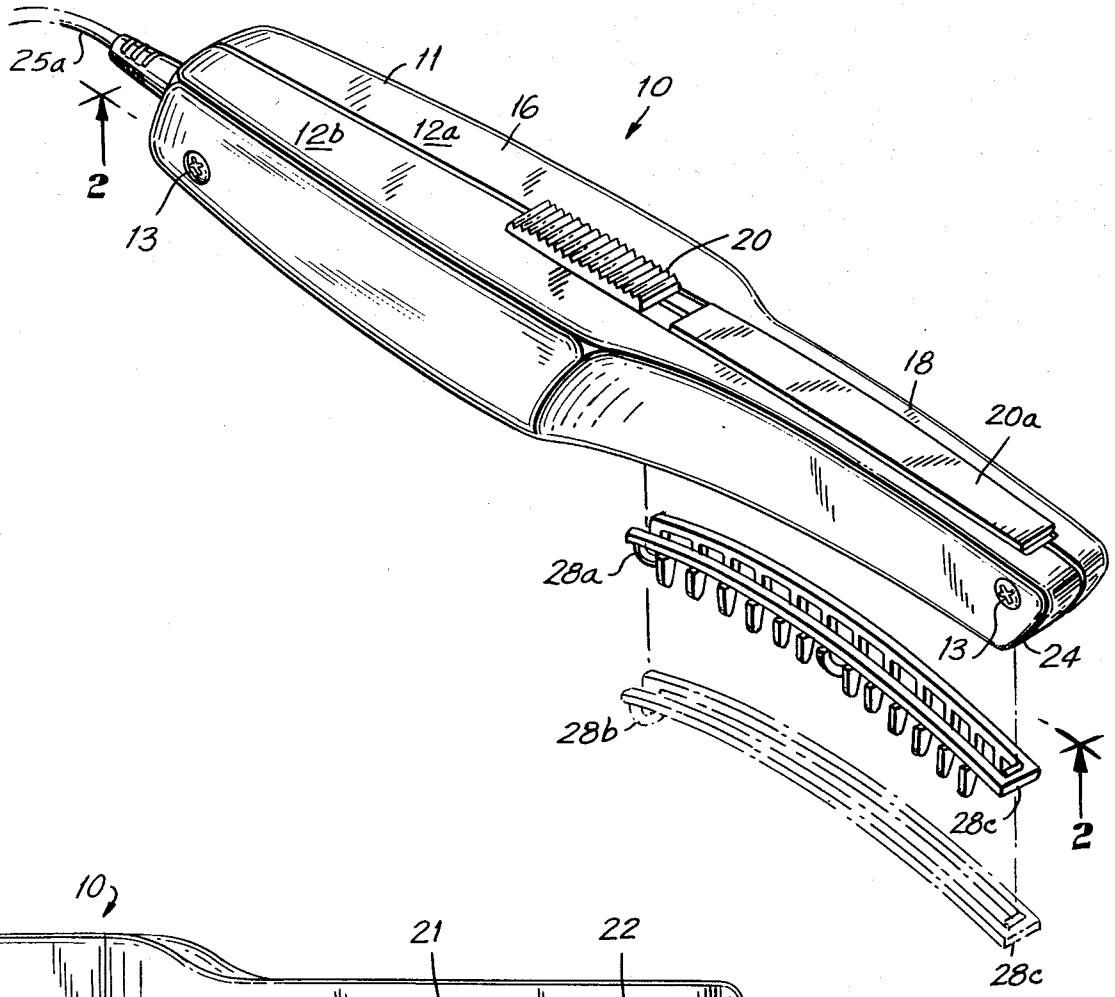
FIG. 1 is a perspective view taken from above and to the left of the casing of a hair trimmer in accordance with the present invention.
Figure 2:
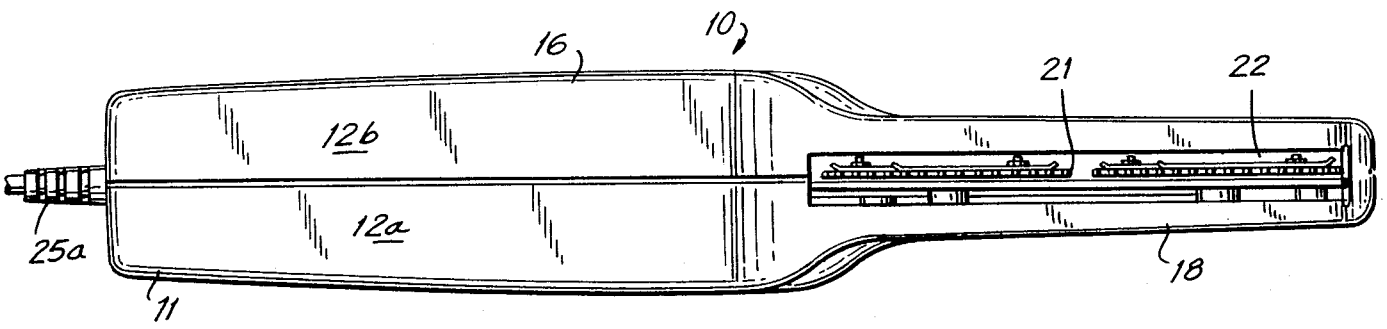
FIG. 2 is a bottom plan view taken along line 2—2 of FIG. 1.
Figure 3:
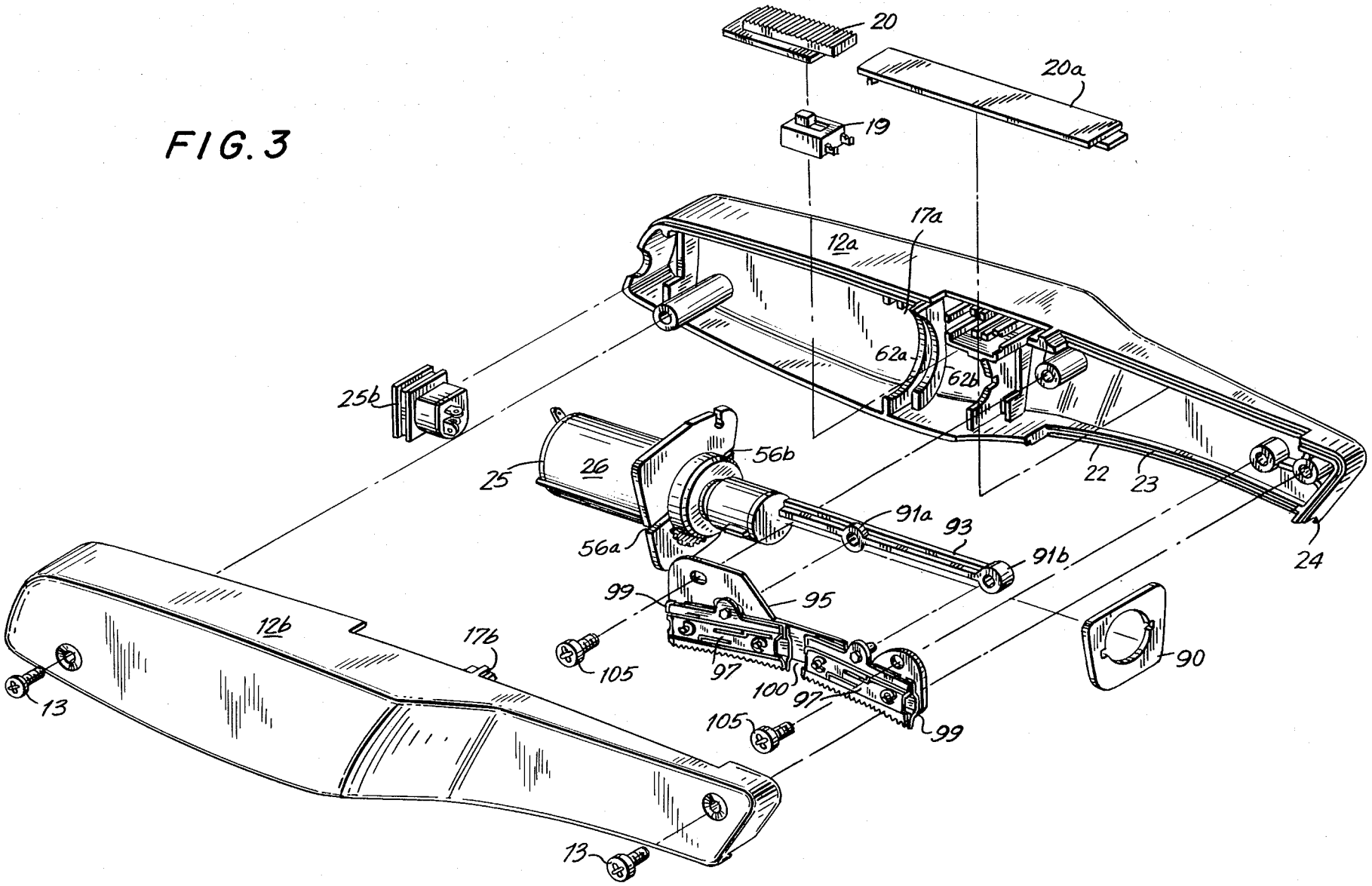
FIG. 3 is an exploded view showing the components of the hair trimmer of FIG. 1.
Figure 4:
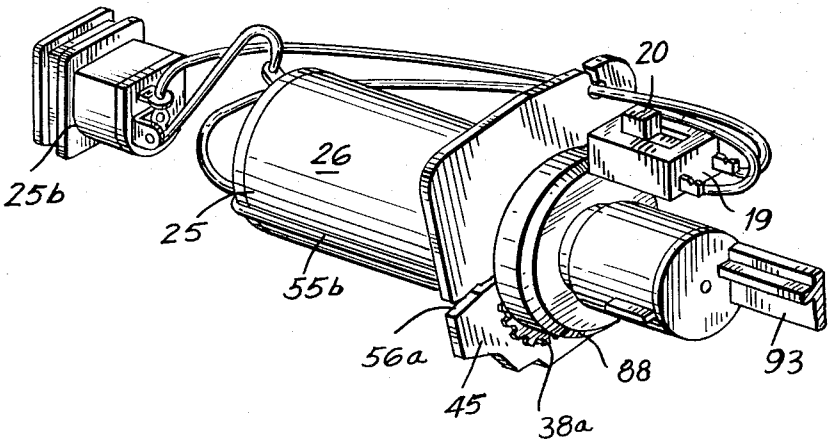
FIG. 4 is a view showing the wiring of the hair trimmer of FIG. 1.
Figure 5:
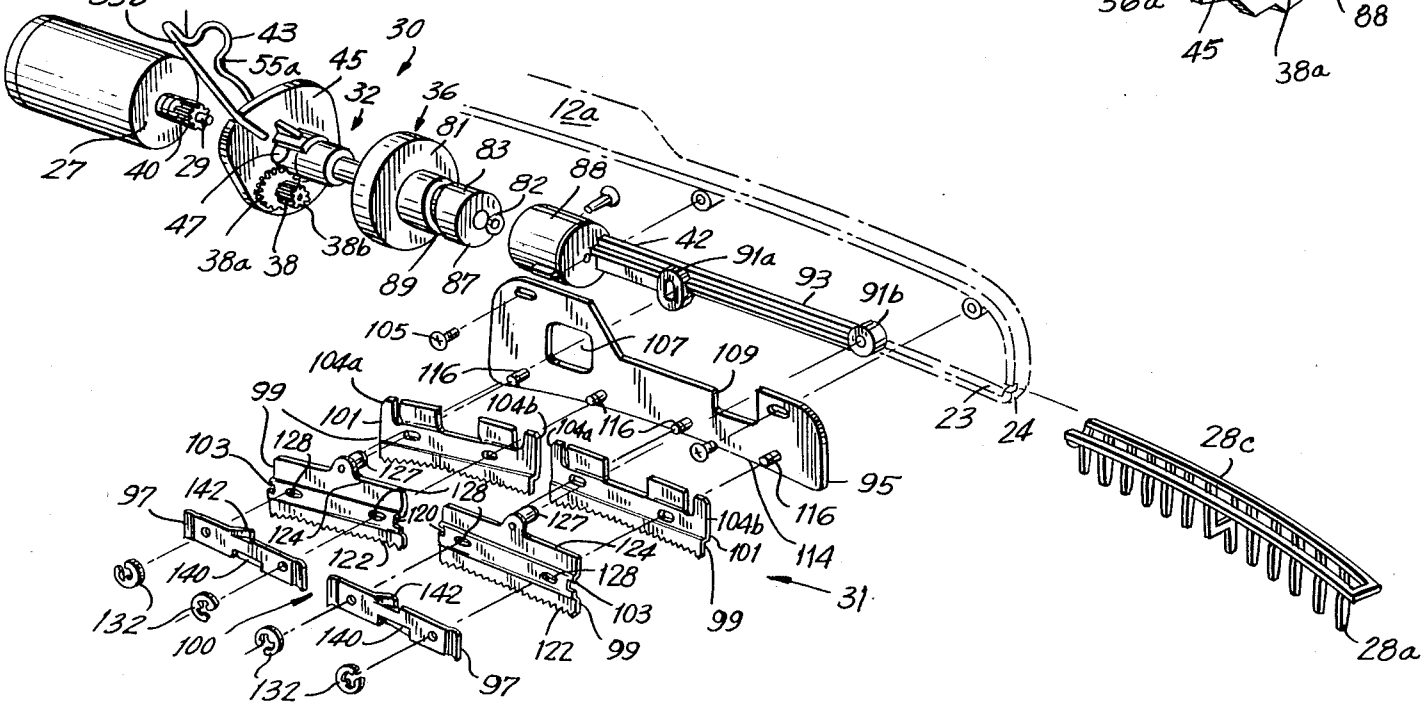
FIG. 5 is an exploded view showing the drive train of the hair trimmer of FIG. 1.
Figure 6:
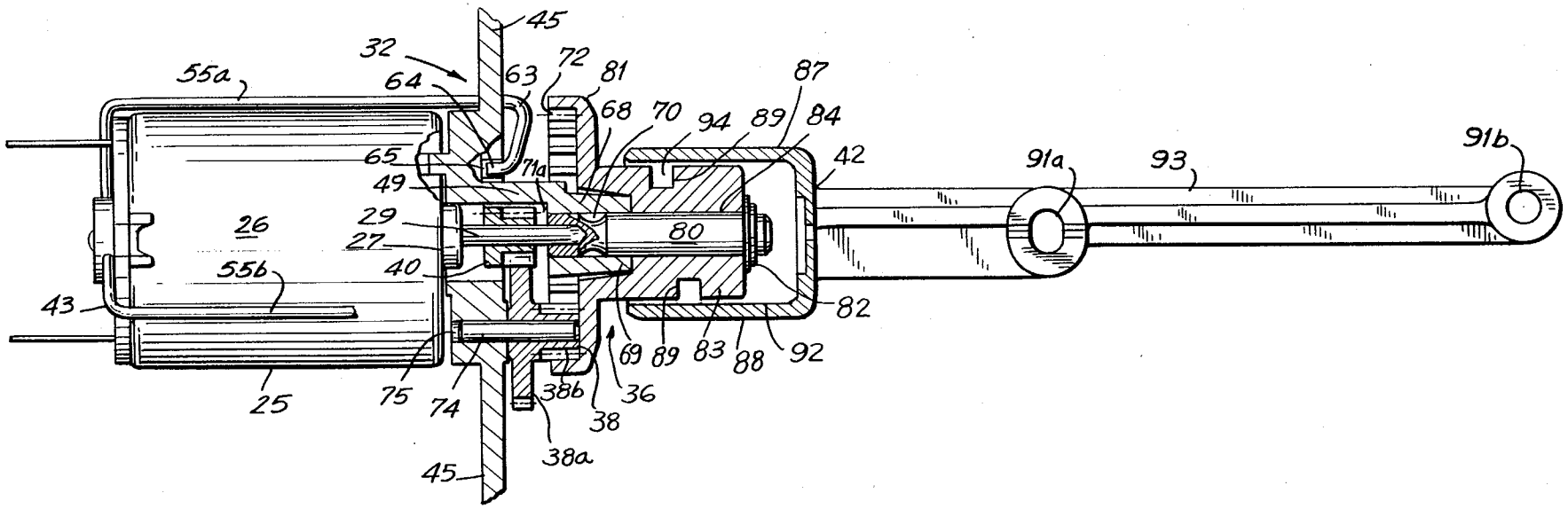
FIG. 6 is a cross-sectional view of the main drive assembly.

Referring now to the Figures, wherein an electric powered hair trimmer, referred to generally by reference numeral 10, includes a hollow casing 11, formed from molded first and second sections, 12*a* and 12*b*, respectively, rigidly secured together by screws 13. The casing 11 includes a handle portion 16 and a cutting portion 18. The handle portion 16 provides a convenient hand grip for either a left or right hand user. A slide switch 20, mounted on top of the casing 11, is finger actuatable for energizing a cutter assembly 21 through switch means 19. The cutter assembly 21 is disposed within the casing 11 and accessible for maintenance through door 20*a*. The handle portion 16 has inner walls 17*a*, 17*b* integrally molded with the sections 12*a* and 12*b*, respectively, which provide support to parts of the cutter assembly 21 and minimize undesirable movement within the casing 11. The cutting portion 18 has a longitudinal slot 22 permitting access to the cutter assembly 21 therethrough. Bordering the slot 22 is a recessed groove 23 which is slidably accessible from end 24 and which permits attachment to accessories such as a comb 28*a* or shaver 28*b* having portion 28*c* mating with the recessed groove 23. The comb 28*a* controls the depth of penetration of the blades of the cutter assembly 31 into the hair. The shaver 28*b* accessory exposes the blades to a greater degree than the comb 28*a* and is particularly useful for close trimming.

The cutter assembly 21 includes a motor 25 for producing rotary motion, reciprocating means 30 for converting rotary motion into reciprocal motion, and cutting means 31 for converting the reciprocating motion to a cutting motion.

The motor 25 is energized by low voltage D.C., supplied through an adaptor (not shown), cord 25*a*, jack 25*b*, or battery (not shown). The motor 25 produces a high rpm and has a housing 26 and a bearing portion 27 with a rotatable output shaft 29 extending therefrom.

The reciprocating means 30 includes a gear housing assembly 32, a cam-gear assembly 36, a cluster gear 38 rotatably secured to the casing 11, a pinion gear 40, and a drive extension 42.

Secured to the bearing portion 27 is the gear housing assembly 32. This assembly 32 includes a motor mounting yoke 43, a flat portion 45 with an aperture 47 to receive the bearing portion 27 of the motor 25 and a forward extension 49. A U-shaped portion 51 of the motor mounting yoke 43 engages the housing 26 of the motor 25. The yoke 43 is formed from a spring grade wire and has opposed legs 55*a*, 55*b* extending forwardly on opposite sides of the motor 25 and through opposite slots 56*a*, 56*b*, respectively, in the flat portion 45. The legs 55*a*, 55*b* each have transverse bends 63, extending towards each other and terminating in rearward extending pin ends 64 which are receivable in a pair of apertures 65 adjacent the slots 56*a*, 56*b*. The motor 25 is positioned and supported against rotation by the snug fit of the bearing portion 27 in the aperture 47, tension on the yoke 43 and the sandwiching of the flat portion 45 between inner wall extensions 62*a*, 62*b* on inner wall 12*a* and opposing wall extensions (not shown) on inner wall 17*b*.

Mounted over and around the output shaft 29 is the forward extension 49 of the gear housing assembly 32, which includes a generally cylindrical chamber 68 formed as an extension of the aperture 47, and an axle extension 69 having a bore 70 which is co-axial with the shaft 29. The forward extension 49 is partially cut away along the cylindrical chamber 68 to provide access to pinion gear 40 mounted on the motor shaft 29.

The cluster gear 38 has a lower larger gear 38*a* and smaller upper gear 38*b* mounted on a pin 74 pressed into a recess 75 in the flat portion 45 of the gear housing assembly 32, and located to provide engagement of the larger gear 38*a* with the teeth 71*a* of the pinion gear 40. The smaller gear 38*b* is positioned to engage the internal teeth 72 of ring 81 of the integral cam-gear assembly 36, which is journalled on a pin 80 pressed into a recess in the axle extension 69. The pinion 40, cluster gear 38, and internally toothed ring 81 form a gear reduction train which reduces the speed of the output shaft 29 to provide a speed range suitable for moving the blades for cutting.

The cam gear assembly 36, mounted over the gear housing assembly 32, includes the ring 81, a barrel cam 83 extending from and integral with the ring 81, and pin 80. The ring 81, as mentioned, has internal teeth 72 which is engaged by the larger gear 38*a* so as to rotate the ring and barrel-cam unit 81, 83. This unit 81, 83 is journalled on the pin 80 and is retained thereon at one end by a washer 82. The pin 80 extends through a bore 84 in the barrel cam 83 into the aligned bore of the axle extension 69 where it is secured. The barrel cam 83 has an external surface 87 with a wobbled circumferential groove 89. A hair guard 90 prevents the hair segments sheared by the cutter assembly 21 from jamming the operation of the barrel-cam unit 81, 83.

The drive extension 42 has a skirt portion 88 and an elongated portion 93 extending therefrom. The elongated portion 93 is secured to the cutting means 31, as described hereinafter, so as to be restrained against rotational movement while permitting reciprocating axial movement to be transmitted from the drive extension 42. The skirt portion 88 has an inner wall 92 with a cam follower 94 extending inwardly therefrom so as to engage the circumferential groove 89. The groove 89 has a continuous path which, during rotation of the gear housing assembly 32 by the cluster gear 38, is traversed by the cam follower 94 so as to move the drive extension 42 in a sinusoidal reciprocating motion and drive the elongated portion 93 in a reciprocating motion.

The elongated portion 93 has a first and second pin receiving aperture 91*a* and 91*b*, respectively, for engaging the cutting means 31, as hereinafter described. The first aperture 91*a* is intermediate the length of the drive extension 42 and has a center line offset from that of the extension 42, while the second aperture 91*b* has a coinciding center line.

The cutting means 31 includes an inner support plate 95, an outer retaining spring 97 and a first and second identical set of tandem blades 99 therebetween, separated by a gap 100; each set includes a stationary blade 101 and a moveable blade 103. Each of the moveable blades 103 are identical with the others, and each of the stationary blades are identical with the others.

The support plate 95 is fixedly secured to the inner wall of the casing 11 by screws 105 and has an opening 107, a recess 109, an inner surface 110, an outer surface and a lower surface 114. The lower surface 114 has a curvature approximating that of the human head. Projecting from the planar inner surface 110, and disposed thereon so as to describe a curved path having a slightly smaller radius of curvature than the curved edge 114, are two pairs of pin rivets 116.

Mounted on each pair of rivets 116, and adjacent to the support plate 95 is a stationary blade 101; each having a flat portion 118 bearing against the support plate 95 and an offset portion 119 projecting beyond the lower surface 114.

Each moveable blade 103 is mounted adjacent a stationary blade 101 and has a bottom planar toothed portion 122, a top planar portion 124 and an offset portion 120 therebetween. The offset portion 120 has two elongated apertures 128; each aperture having dimensions permitting the moveable blades 103 to slide reciprocably about the pair of pins 116 and along the corresponding stationary blade 101. Each offset portion 120 does not contact a stationary blade 101; this arrangement minimizing friction and wear and tear on the cutting components. Each bottom planar toothed portion 122 and top planar portion 124 bears against the corresponding portion of the stationary blade 101. The bottom portion 122 has similarly sized teeth having tips which define a blade edge curvature having a slightly smaller radius than that of each stationary blade 101.

Each top portion 124 has a riveted pin 127 extending inwardly. One pin extends through the opening 107 and engages the first pin-engaging aperture 91*a*, while the other pin extends through the recess 109 and engages the second aperture 91*b*. The dimensions of opening 107 and recess 109 are such that the support plate 95 does not interfere with the motion of each of the rivet pins 127.

The width of each moveable blade 103 is less than that of the adjacent stationary blade 101, and the reciprocating motion moves each moveable blade 103 cyclically and repetitively from one substantially vertical end 104*a* of the corresponding stationary blade to the other substantially vertical end 104*b* simultaneously.

Mounted on each pair of pin rivets 116, and forcing the blades of each tandem set 99 against each other is a retaining spring 97 locked thereon by washers 132. Each spring 130 has a first and second pressure producing spring arm 140, 142, respectively. The arms 140, 142 supply a bearing pressure to the bottom and top portions of the moveable blade 103 so as to maintain the moveable blades in slideable contact with the stationary blade 101.

The hair trimmer is operated by moving the slide switch 20 to on and activating the motor 25 which turns the output shaft 29 and the attached pinion gear 40. The pinion gear 40 rotates the cluster gear 38, with the smaller gear 38*b* rotating the barrel-cam gear assembly 36 and driving the elongated portion 93 of the drive extension 42 in a reciprocating motion. This motion is transmitted to the coupled, aligned, curved and moveable blades 103 which cooperate with the curved stationary blades 101 so as to shear hair drawn between their teeth when moving the cutting portion 18 through a bed of hair.

What is claimed is:

1. A cutting unit comprising:

a cutting assembly including multiple sets of tandem arcuate blades, said multiple sets being longitudinally aligned and arranged in order to conform the cutting surfaces of all sets along a single substantially arcuate path, each set comprising opposing first and second toothed arcuate blades, each said first toothed arcuate blade bearing against and longitudinally slidable along the corresponding second toothed arcuate blade in a longitudinally reciprocating cutting motion, said first blades of each set being coupled for simultaneous longitudinal reciprocating motion relative to the corresponding second blades of each set; and reciprocating means for producing said longitudinal reciprocating motion of all said first blades simultaneously.

2. The cutting unit of claim 1 further comprising a hand holdable casing partly surrounding said cutting assembly and having a longitudinal slot, said tandem blade sets extending at least partly from said slot.

3. The cutting unit of claim 1 wherein said second toothed blades are stationary.

4. The cutting unit of claim 3 wherein said stationary second toothed blades are fixedly secured to a support plate, said support plate being fixedly secured to said housing.

5. The cutting unit of claim 1 wherein said reciprocating means comprises a motor having a rotatable shaft, a cylindrical cam interconnected with and for being rotated by said shaft, said cam having a wobbled circumferential groove in the surface thereof, a cam follower having an extension, said extension being substantially aligned with the axis of said rotatable shaft, said cam follower engaging said groove so as to reciprocate said extension when traversing said groove upon rotation of said shaft, said first blades being attached to said extension for reciprocating therewith.

6. The cutting unit of claim 2 wherein said longitudinal slot has a peripheral groove detachably engageable by an accessory having a portion with said groove.

7. The cutting unit of claim 6 wherein said accessory is a comb having bristles projecting outward from the periphery of said mating portion.

8. The cutting unit of claim 1 wherein said first blades are substantially similar dimensionally to one another, and said second blades are substantially similar dimensionally to one another.

9. The cutting unit of claim 1 wherein said first tooth blade extends at least partly vertically and horizontally along said second tooth blade of said same set and moves from one vertical edge to the other vertical edge during reciprocation.

10. The cutting unit of claim 1 wherein each of said multiple first blades have a curved toothed edge which are aligned with the other first blades to form a concave curvature having a predetermined radius corresponding approximately to a portion of a human head, and said second blades are aligned to form a curvature with a radius smaller than said predetermined curvature.

11. The cutting unit of claim 10 wherein each tandem set is separated from an adjacent set by a gap.

* * * * *